US009790448B2

(12) United States Patent
Epshteyn et al.

(10) Patent No.: US 9,790,448 B2
(45) Date of Patent: Oct. 17, 2017

(54) SPHERICAL COPPER/MOLYBDENUM DISULFIDE POWDERS, METAL ARTICLES, AND METHODS FOR PRODUCING SAME

(71) Applicant: Climax Engineered Materials, LLC, Phoenix, AZ (US)

(72) Inventors: Yakov Epshteyn, Sahuarita, AZ (US); Lawrence J. Corte, Phoenix, AZ (US); Carl V. Cox, Sahuarita, AZ (US); Matthew C. Shaw, Sahuarita, AZ (US); Alejandra Banda, Sahuarita, AZ (US)

(73) Assignee: Climax Engineered Materials, LLC, Phoenix, AZ (US)

( * ) Notice: Subject to any disclaimer, the term of this patent is extended or adjusted under 35 U.S.C. 154(b) by 491 days.

(21) Appl. No.: 13/827,325

(22) Filed: Mar. 14, 2013

(65) Prior Publication Data

US 2014/0024564 A1 Jan. 23, 2014

Related U.S. Application Data

(60) Provisional application No. 61/673,429, filed on Jul. 19, 2012.

(51) Int. Cl.
*C10M 125/22* (2006.01)
*B22F 5/00* (2006.01)
(Continued)

(52) U.S. Cl.
CPC ..... *C10M 125/22* (2013.01); *B22F 5/00* (2013.01); *B22F 5/02* (2013.01); *B22F 5/10* (2013.01);
(Continued)

(58) Field of Classification Search
CPC . C10M 125/22; B22F 5/00; B22F 3/18; B22F 2998/00
(Continued)

(56) References Cited

U.S. PATENT DOCUMENTS 3,479,289 A 11/1969 Van Wyk
3,764,308 A * 10/1973 Neumann et al. ..... B22F 3/18 419/10
(Continued)

FOREIGN PATENT DOCUMENTS

CA 2803930 A1 1/2012
EP 0161462 A1 11/1985
(Continued)

OTHER PUBLICATIONS

International Search Report & Written Opinion for PCT/US2011/041340, dated Oct. 27, 2011, 8 pages.
(Continued)

*Primary Examiner* — Weiping Zhu
(74) *Attorney, Agent, or Firm* — Fennemore Craig, P.C.

(57) ABSTRACT

A method of producing a compacted article according to one embodiment may involve the steps of: Providing a copper/molybdenum disulfide composite powder including a substantially homogeneous dispersion of copper and molybdenum disulfide sub-particles that are fused together to form individual particles of the copper/molybdenum disulfide composite powder; and compressing the copper/molybdenum disulfide composite powder under sufficient pressure to cause the copper/molybdenum disulfide composite powder to behave as a nearly solid mass.

40 Claims, 9 Drawing Sheets

(51) Int. Cl.

| | |
|---|---|
| ***C10M 125/04*** | (2006.01) |
| ***B22F 9/02*** | (2006.01) |
| ***C22C 1/10*** | (2006.01) |
| ***C22C 32/00*** | (2006.01) |
| ***C10M 177/00*** | (2006.01) |
| ***C10M 103/06*** | (2006.01) |
| ***B22F 5/02*** | (2006.01) |
| ***B22F 5/10*** | (2006.01) |
| *B22F 9/04* | (2006.01) |

(52) U.S. Cl.
CPC ..... *B22F 9/026* (2013.01); *C10M 103/06* (2013.01); *C10M 125/04* (2013.01); *C10M 177/00* (2013.01); *C22C 1/1026* (2013.01); *C22C 1/1084* (2013.01); *C22C 32/0089* (2013.01); *B22F 2009/045* (2013.01); *B22F 2998/10* (2013.01); *C10M 2201/065* (2013.01); *C10M 2201/066* (2013.01); *C10M 2209/04* (2013.01); *C10N 2210/01* (2013.01); *C10N 2220/082* (2013.01); *C10N 2230/06* (2013.01); *C10N 2250/08* (2013.01); *C10N 2250/12* (2013.01)

(58) Field of Classification Search
USPC ..... 508/169
See application file for complete search history.

(56) References Cited

U.S. PATENT DOCUMENTS

| | | | |
|---|---|---|---|
| 4,039,697 | A | 8/1977 | Isawa et al. |
| 4,599,110 | A | 7/1986 | Kohler et al. |
| 4,950,413 | A | 8/1990 | Boes et al. |
| 5,332,422 | A | 7/1994 | Rao |
| 5,358,753 | A | 10/1994 | Rao et al. |
| 5,476,632 | A | 12/1995 | Shivanath et al. |
| 5,484,662 | A | 1/1996 | Rao |
| 5,702,769 | A | 12/1997 | Peters |
| 5,886,854 | A | 3/1999 | Diaz et al. |
| 5,958,846 | A | 9/1999 | Geringer |
| 5,972,070 | A | 10/1999 | Kondoh et al. |
| 5,980,819 | A | 11/1999 | Nakagawa et al. |
| 6,355,207 | B1 | 3/2002 | Keyes |
| 6,376,103 | B1 | 4/2002 | Sampath et al. |
| 6,395,202 | B1 | 5/2002 | Nagel et al. |
| 6,599,345 | B2 | 7/2003 | Wang et al. |
| 6,623,876 | B1 | 9/2003 | Caron |
| 6,689,424 | B1 | 2/2004 | Wang et al. |
| 6,815,400 | B2 | 11/2004 | Jee et al. |
| 7,470,307 | B2 | 12/2008 | Larink, Jr. |
| 8,038,760 | B1 | 10/2011 | Shaw et al. |
| 2004/0234407 | A1 | 11/2004 | Szabo et al. |
| 2005/0069448 | A1 | 3/2005 | Sato et al. |
| 2006/0079410 | A1 | 4/2006 | Yadav |
| 2006/0199747 | A1 | 9/2006 | Kamimura et al. |
| 2007/0166478 | A1 | 7/2007 | Itsukaichi et al. |
| 2007/0227390 | A1 | 10/2007 | Palmateer |
| 2008/0144219 | A1 | 6/2008 | Burns et al. |
| 2008/0146467 | A1 | 6/2008 | Takayama |
| 2009/0098010 | A1 | 4/2009 | Johnson et al. |
| 2009/0123690 | A1 | 5/2009 | Scholl et al. |
| 2011/0236596 | A1 | 9/2011 | Skorb et al. |
| 2012/0006676 | A1 | 1/2012 | Honecker et al. |
| 2012/0009080 | A1 | 1/2012 | Shaw et al. |

FOREIGN PATENT DOCUMENTS

| | | | |
|---|---|---|---|
| GB | 1295508 | A | 11/1972 |
| JP | S53-58910 | A | 5/1978 |
| JP | S56-013451 | | 9/1981 |
| JP | S58-071352 | | 4/1983 |
| JP | S62-196351 | A | 8/1987 |
| JP | 2004-124130 | A | 4/2004 |
| KR | 20060070833 | A | 6/2006 |
| UA | 56743 | C2 | 5/2003 |
| WO | 03090319 | A1 | 10/2003 |

OTHER PUBLICATIONS

International Search Report & Written Opinion for PCT/US2011/041344, dated Nov. 17, 2011, 9 pages.

Epshteyn, Yakov, et al., "Molybdenum Disulfide in Lubricant Applications—A Review," Climax Molybdenum—A Freeport-McMoRan Company, Phoenix, AZ; Presented at the 12 Lubricating Grease Conference, NLGI—India Chapter, Hotel Cedade de Goa, Goa, India, Jan. 28-30, 2010, pp. 1-12.

Subramanian, P.R. et al., "The Cu—Mo (Copper-Molybdenum) System," Bulletin of Alloy Phase Diagrams, vol. 11, No. 2, (1999), pp. 169-172.

Daloz, William, et al., "Molybdenum-Silicate Multiphase Composites: Oxidation Concerns," Conference Tools for TMS Annual Meeting & Exhibition-Symposium Refractory Metal 2011; http://www.programmaster.org/PM/PM.nsf/ApprovedAbstracts/76EC94661, Sep. 27, 2012.

Yao, Zhengui, et al., "Molybdenum Silicide Based Materials and Their Properties," Materials Modification, Inc., 2929 Eskridge Road, P-1, Fairfax, VA 22031, pp. 1-29.

Clauss, F.J. and Kingery, M.K., "Sliding Electrical Contact Materials for Use in Ultrahigh Vacuum," vol. 4, No. 4, Apr. 4, 1967, pp. 480-485.

Supp. European Search Report for European Application No. 11804042.7, dated Sep. 24, 2013, 3 pages.

PCT International Search Report and Written Opinion, PCT Application No. PCT/US2013/0049240, dated Dec. 24, 2013, 10 pages.

Supplementary European Search Report for European Patent Application No. EP 13819584.7, dated Mar. 22, 2016, 13 pages.

Database Compendex [Online]—Engineering Information, Inc., New York, NY, US; 2009, Yamada M et al, "Fabrication of Cu—MoS2 composite coating by cold spraying and evaluation of its property," Database accession No. E20100812721279; & Proceedings of the International Thermal Spray Performance to New Markets and Applications—Proceedings of the 2009 International Thermal Spray Conference, ITSC 2009 2009 ASM International USA, 2009, pp. 326-330, DOI: 10.1361/CP2009ITSC0326.

Kulkarni, P. A., et al., "Review of the flowability measuring techniques for powder metallurgy industry," Proceedings of the Institute of Mechanical Engineers, Part E: Journal of Process Mechanical Engineering, Mechanical Engineering Pub., London, GB, vol. 224, No. 3, Aug. 1, 2010, pp. 159-168, XP008179316, ISSN: 0954-4089, DOI: 10.1243/09544089JPME299.

Japanese Office Action dated Jan. 20, 2016, for Japanese Patent Application No. 2015-523116, and English translation, 11 pages.

Canadian Examiner's Report, dated Jun. 2, 2016, for Canadian Patent Application No. 2,878,562, corresponding to PCT/US2013/049240.

Chen, Shuxian et al., "Friction and Wear Behaviors of Cu-based Self Lubrication Composites under Room Temperature in Atmosphere," Runhua Yue Mifeng (2009), 34(6), pp. 23-27 and 35.

Chen Shuxian, et al., "Friction and Wear Behaviors of Cu-based Self Lubrication Composites under Room Temperature in Atmosphere," Runhua Yue Mifeng (Jun. 2009), vol. 34, No. 6, pp. 23-27, and 35. (Certified English translation of entire article).

"Properties of Molybdenum Disulfide, (Molysulfide Reg. TM)," owned by Cyprus Amax Minerals Company, a Delaware Corporation, Climax Molybdenum—A Freeport-McMoRan Company 333 North Central Avenue, Phoenix, AZ 85004, http://www.climaxmolybdenum.com, Jun. 2014, 9 pages.

Parker, Sybil P., Editor in Chief, "McGraw-Hill Dictionary of Scientific and Technical Terms, Fifth Edition," McGraw Hill, Inc., New York et al., pp. 1560 and 1936.

* cited by examiner

SPHERICAL COPPER/MOLYBDENUM DISULFIDE POWDERS, METAL ARTICLES, AND METHODS FOR PRODUCING SAME

CROSS-REFERENCE TO RELATED APPLICATION

This application claims the benefit of U.S. Provisional Patent Application No. 61/673,429, filed on Jul. 19, 2012, which is hereby incorporated herein by reference for all that it discloses.

TECHNICAL FIELD

This invention relates to composite powders in general and more specifically to a composite powder comprising copper and molybdenum disulfide and to articles and coatings made therefrom.

BACKGROUND

Molybdenum disulfide ($MoS_2$) is a crystalline sulfide of molybdenum and is commonly used as a lubricant due primarily to its high lubricity and stability at high temperatures. Molybdenum disulfide may be used in either its dry or powder form or may be combined with a variety of oils and greases. Molybdenum disulfide may also be used to form molybdenum disulfide coatings on any of a wide range of articles, typically to enhance the lubricity of such materials. Molybdenum disulfide powders may also be combined with various materials, such as metals, metal alloys, resins, and polymers, to enhance the properties thereof.

While molybdenum disulfide-based lubricants are highly effective and widely used, new materials and formulations are constantly being sought that will provide better performance and that can be used in new applications and environments.

SUMMARY OF THE INVENTION

A method of producing a copper/molybdenum disulfide composite powder according to one embodiment includes the steps of: Providing a supply of copper-containing powder; providing a supply of molybdenum disulfide powder; combining the copper and molybdenum disulfide powders with a liquid to form a slurry; feeding the slurry into a pulsating stream of hot gas; and recovering the copper/molybdenum disulfide composite powder, the copper/molybdenum disulfide composite powder comprising a substantially homogeneous dispersion of copper and molybdenum disulfide sub-particles that are fused together to form individual particles of the copper/molybdenum disulfide composite powder.

Also disclosed is a compacted article comprising a copper/molybdenum disulfide composite powder compressed under sufficient pressure to cause the copper/molybdenum disulfide composite powder to behave as a nearly solid mass, the copper/molybdenum disulfide composite powder comprising a substantially homogeneous dispersion of copper and molybdenum disulfide sub-particles that are fused together to form individual particles of said composite powder.

A method of producing a compacted article may include the steps of: Providing a copper/molybdenum disulfide composite powder comprising a substantially homogeneous dispersion of copper and molybdenum disulfide sub-particles that are fused together to form individual particles of said copper/molybdenum disulfide composite powder; and compressing the copper/molybdenum disulfide composite powder under sufficient pressure to cause said copper/molybdenum disulfide composite powder to behave as a nearly solid mass.

In another embodiment, a method of producing a compacted metal article, may include: Providing a granulated copper/molybdenum disulfide powder comprising a substantially homogeneous dispersion of copper and molybdenum disulfide sub-particles that are aggregated together to form individual particles of said granulated copper molybdenum disulfide powder; and compressing said granulated copper/molybdenum disulfide powder under sufficient pressure to cause said granulated copper/molybdenum disulfide powder to behave as a nearly solid mass.

BRIEF DESCRIPTION OF THE DRAWINGS

Illustrative and presently preferred exemplary embodiments of the invention are shown in the drawings in which.

DETAILED DESCRIPTION OF THE PREFERRED EMBODIMENTS

Figure 1:
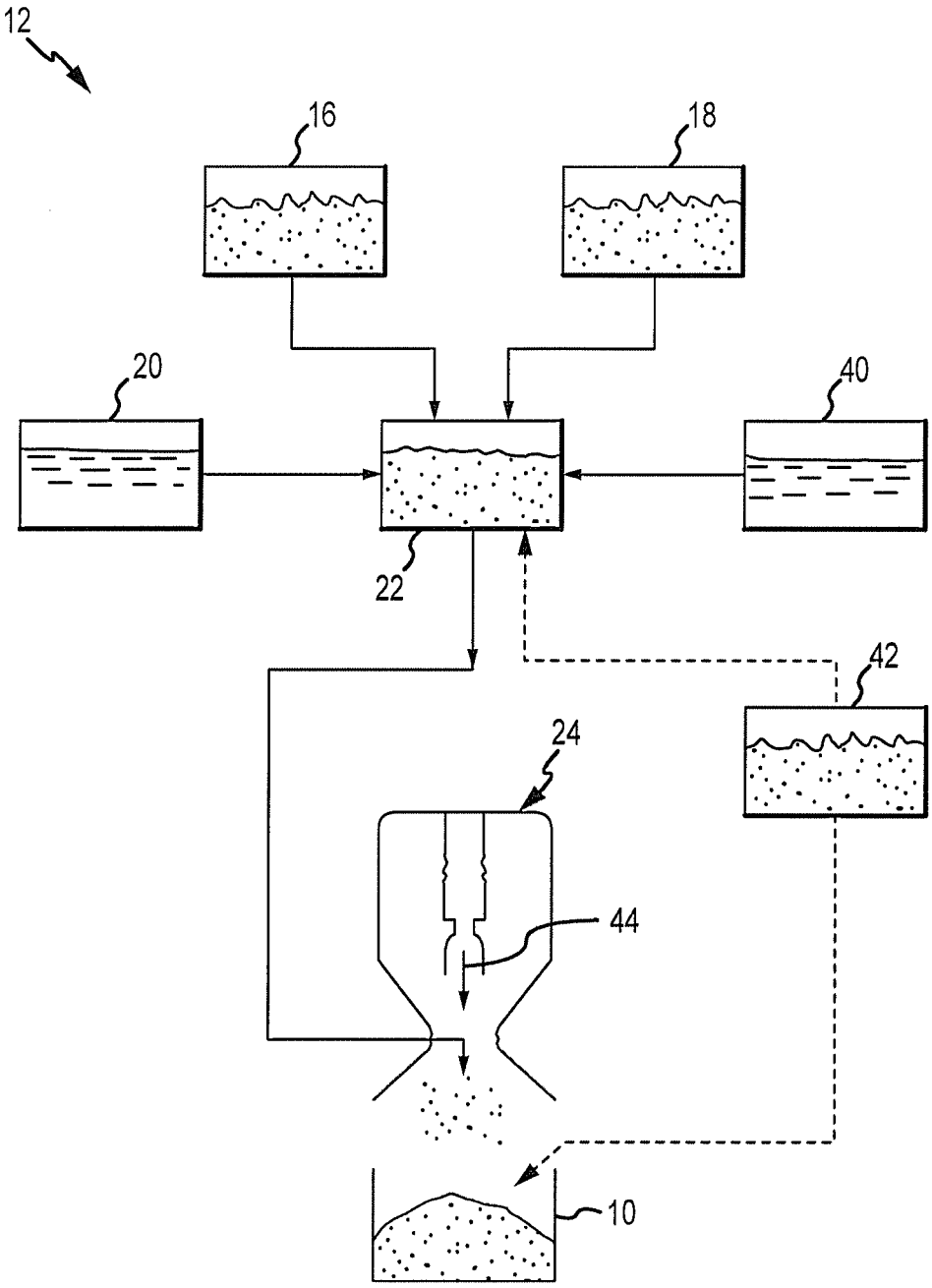
FIG. 1 is a process flow chart of basic process steps in one embodiment of a method for producing a copper/molybdenum disulfide composite powder.

A copper/molybdenum disulfide ($Cu/MoS_2$) composite powder 10 according to one embodiment of the present invention may be produced by a process 12 illustrated in FIG. 1. Briefly, process 12 may comprise providing a supply of a copper-containing powder 16, such as copper metal (Cu) powder, and a supply of a molybdenum disulfide ($MoS_2$) powder 18. The copper powder 16 and molybdenum disulfide powder 18 may then be combined with a liquid 20, such as water, to form a slurry 22. The slurry 22 may then be spray dried in a spray dryer 24 in order to produce the copper/molybdenum disulfide composite powder 10.

Figure 4A:
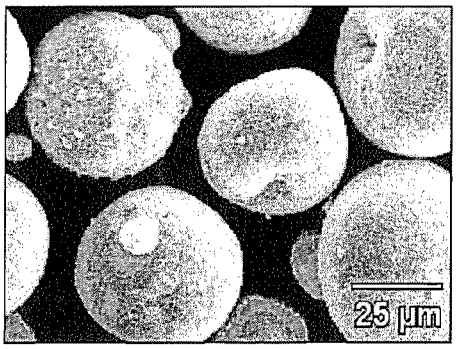
FIG. 4*a* is a scanning electron micrograph of copper/molybdenum disulfide composite powder produced from a Trial 1 embodiment showing individual agglomerated sub-particles.
Figure 4B:
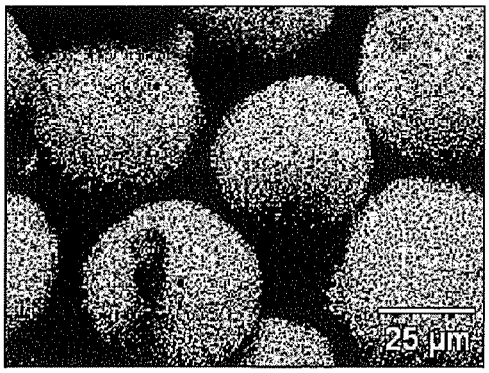
FIG. 4*b* is a spectral map produced by energy dispersive x-ray spectroscopy showing the dispersion of sulfur in the image of FIG. 4*a;*
Figure 4C:
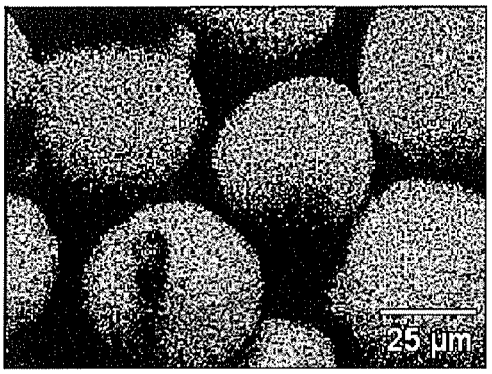
FIG. 4*c* is a spectral map produced by energy dispersive x-ray spectroscopy showing the dispersion of molybdenum in the image of FIG. 4*a;*
Figure 4D:
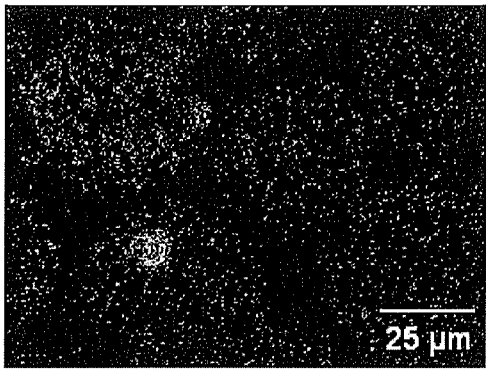
FIG. 4*d* is a spectral map produced by energy dispersive x-ray spectroscopy showing the dispersion of copper in the image of FIG. 4*a;*
Figure 4E:
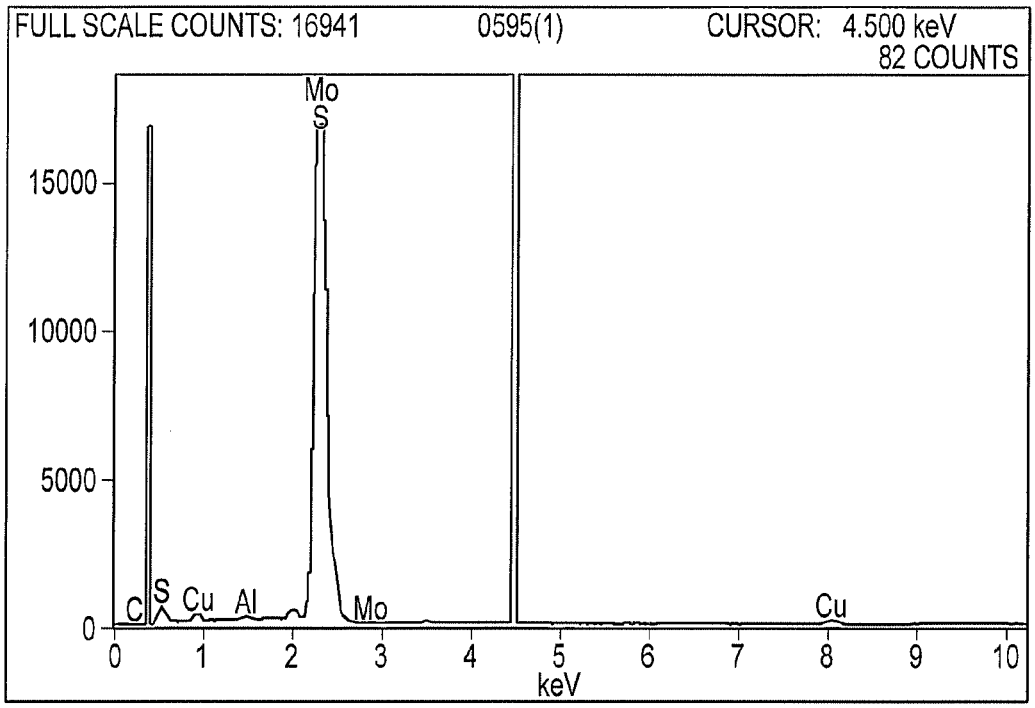
FIG. 4*e* is a spectrum produced by energy dispersive x-ray spectroscopy showing various characteristic peaks associated with elements of the powder sample shown in FIGS. 4*a-d;*
Figure 5A:
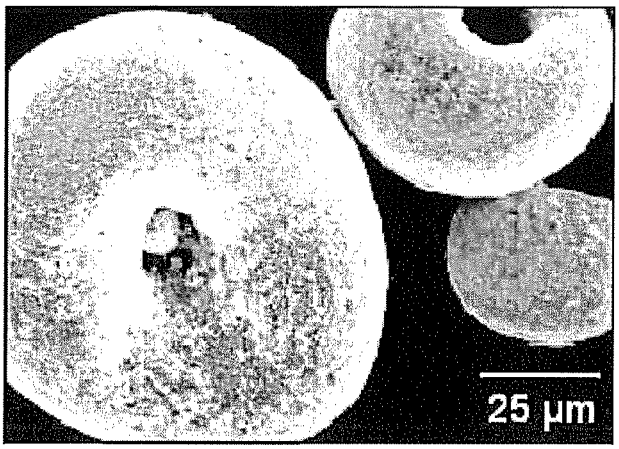
FIG. 5*a* is a scanning electron micrograph of copper/molybdenum disulfide composite powder produced from a Trial 3 embodiment showing individual agglomerated sub-particles.
Figure 6A:
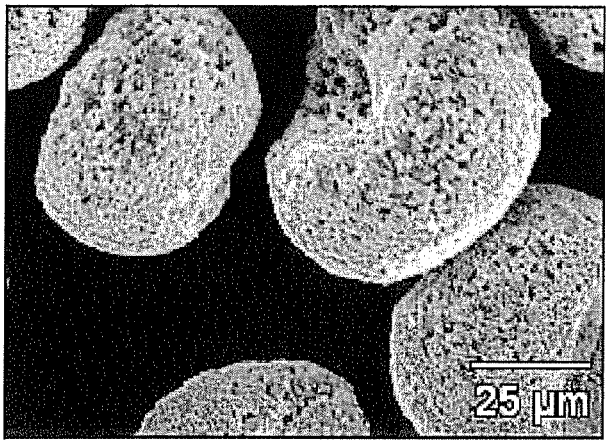
FIG. 6*a* is a scanning electron micrograph of copper/molybdenum disulfide composite powder produced from a Trial 4 embodiment showing individual agglomerated sub-particles.

The copper/molybdenum disulfide composite powder 10 may comprise a plurality of generally spherically-shaped particles that are themselves agglomerations of smaller particles, as best seen in FIGS. 4*a*, 5*a*, and 6*a*. Further, the molybdenum disulfide and copper are highly dispersed within one another, as evidenced by the spectral maps acquired by energy dispersive x-ray spectroscopy (EDS), shown herein as FIGS. 4(*c*,*d*), 5(*b*,*c*), and 6(*b*,*c*). That is, the copper/molybdenum disulfide composite powder 10 of the present invention is not a mere combination of copper and molybdenum disulfide powders. Rather, the composite powder 10 comprises a substantially homogeneous mixture of copper and molybdenum disulfide on a particle-by-particle basis. The individual spherical powder particles comprise sub-particles of copper and molybdenum disulfide that are fused together, so that individual particles of the composite powder 10 comprise both copper and molybdenum disulfide, with each particle containing approximately the same proportions of copper and molybdenum disulfide.

The copper/molybdenum disulfide composite powder 10 is also of high density and possesses favorable flow characteristics. For example, and as will be discussed in further detail herein, exemplary copper/molybdenum disulfide composite powders 10 produced in accordance with the teachings provided herein should have Scott densities in a range of about 0.9 g/cc to about 1.2 g/cc. The composite powder product 10 is also quite flowable, and embodiments should exhibit Hall flowabilities in a range of about 50 s/50 g to about 150 s/50 g for the various example compositions shown and described herein.

Figure 2:
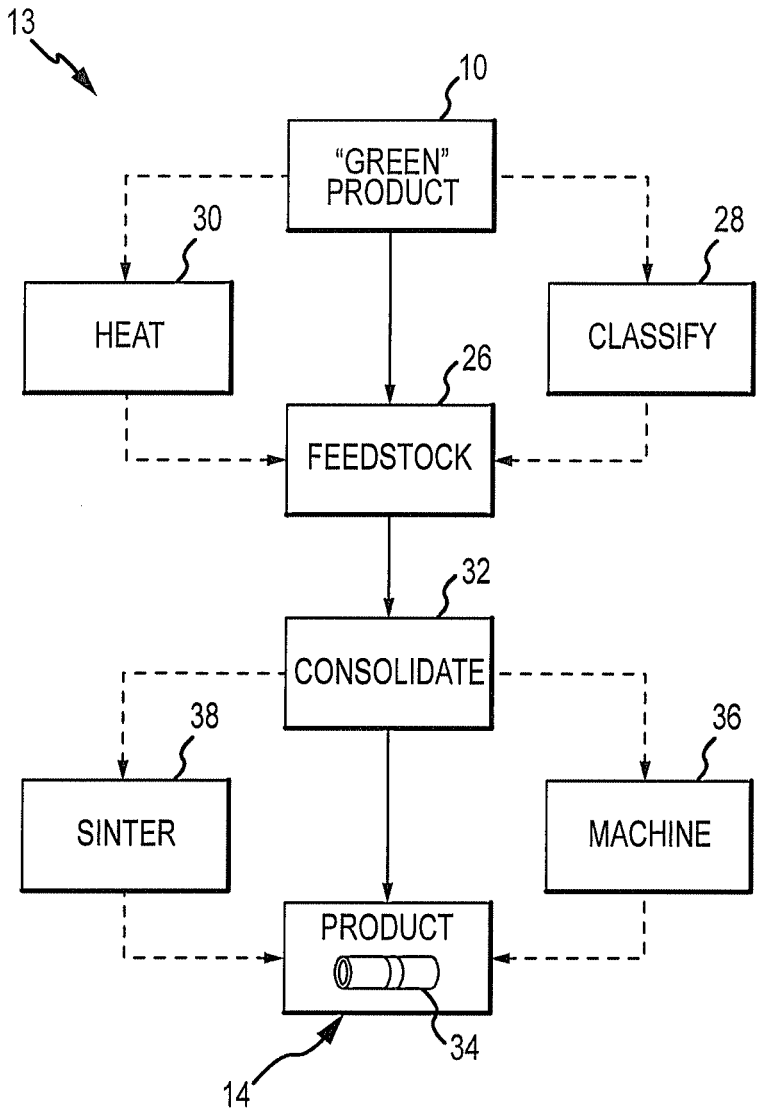
FIG. 2 is a process flow chart of basic process steps in one embodiment of a method for producing compacted articles from the copper/molybdenum disulfide composite powder.

The copper/molybdenum disulfide composite powder 10 is useful in a wide range of applications and fields. For example, compositional embodiments of the copper/molybdenum disulfide composite powder 10 (e.g., generally those compositions comprising primarily copper) may be consolidated or compacted into solid parts or compacted articles 14, as best seen in FIG. 2. In another example, compositional embodiments of the copper/molybdenum disulfide composite powders 10 (e.g., generally those compositions comprising primarily molybdenum disulfide) may be used as feedstock materials in the manufacture of lubricants and greases having improved thermal and electrical conductivities.

Referring now primarily to FIG. 2, a process 13 may be used to consolidate or compact the copper/molybdenum disulfide powder 10 into a compacted article 14. By way of example, in one embodiment, the compacted article 14 may comprise a slip ring 34 of the type commonly used in electrical generators. In another embodiment, the compacted article 14 may comprise an electrically conductive brush (not shown) of the type commonly used in electric motors and generators. In still yet another embodiment, the compact article 14 may comprise an electrically conductive contact shoe (also not shown) for contacting power rails or overhead contact wires of the type used in electrically powered train systems. In most embodiments, such compacted articles 14 will be formed from copper/molybdenum disulfide powder 10 comprising substantial amounts of copper. However, and as will be described in much greater detail herein, other embodiments may involve the formation of compacted articles 14 from composite powders 10 that comprise substantial quantities of molybdenum disulfide and much lower amounts of copper.

Regardless of the relative amounts of copper and molybdenum disulfide that comprise any particular powder formulation, the copper/molybdenum disulfide composite powder 10 may be used in its as-recovered or "green" form (i.e., directly from spray dryer 24) as a feedstock 26 to produce the compacted article 14. Alternatively, the "green" composite powder 10 may be further processed, e.g., by screening or classification 28, by heating 30, or by combinations thereof, before being used as feedstock 26. The copper/molybdenum disulfide composite powder feedstock 26 may be compacted or consolidated at step 32 in order to produce the compacted article 14. Suitable consolidation processes 32 include, but are not limited to, axial pressing, hot isostatic pressing (HIPing), warm isostatic pressing (WIPing), cold isostatic pressing (CIPing), and sintering.

The various exemplary embodiments described herein are expected to have green densities in the range of about 4.3 g/cc to about 6.4 g/cc, depending on the relative proportions of copper involved. Generally speaking, compacted articles comprising lower amounts of copper (e.g., about 5 wt. % Cu) should have lower green densities (e.g., about 4.3 g/cc), whereas compacted articles comprising higher amounts of copper (e.g., about 95 wt. % Cu) should have higher green densities (e.g., about 6.4 g/cc).

The friction coefficients of the resulting compacted metal articles will also vary depending on the amount of copper comprising the metal article, and are expected to range from about 0.2 to about 0.7, with lower friction coefficients being expected for metal articles comprising lower amounts of copper (e.g., about 5 wt. % Cu). The friction coefficient is expected to increase in proportion to the amount of copper contained in the compacted metal article (e.g., up to about 95 wt. % Cu), but should still be significantly lower than the friction coefficient of pure copper (e.g., typically about 0.75) due to the presence of molybdenum disulfide (which typically displays friction coefficients in the range of 0.04 to about 0.2).

After being compressed, the compacted article 14 may be used "as is" directly from the consolidation process 32. Alternatively, the compacted article 14 may be further processed, e.g., by machining 36, by sintering 38, or by combinations thereof, in which case the compacted article 14 will comprise a processed compacted article.

As will be described in greater detail herein, various properties and material characteristics of the compacted article 14 (e.g., slip ring 34, brush, or contact shoe) of the present invention may be altered or varied by changing the relative proportions of copper and molybdenum disulfide in the composite powder 10. For example, the electrical and thermal conductivities of the compacted article 14 may be increased by decreasing the concentration of molybdenum disulfide in the composite powder 10. Conversely, the lubricity and/or wear resistance of such a compacted article 14 may be increased by increasing the concentration of molybdenum disulfide in the composite powder 10. Such increased lubricity and/or wear resistance may be advantageous in situations wherein the compacted article 14 is to be used to provide "transfer" lubrication, such as in slip rings 34, commutators, and brushes in electric generators and motors. In other embodiments, such increased transfer lubrication may serve as coating protection for wear surfaces or contact points, such as those found in electrical motors, switch gear, circuit breakers, and the like. In addition, various properties and material characteristics of the compacted article 14 may be varied by adding various alloying metals, such as, for example, nickel, tin, lead, zinc, and beryllium (as well as various alloys thereof) to the composite powder 10, as also will be explained in greater detail herein.

In other embodiments, the composite powder 10 need not be compacted or consolidated at all, but instead may be used as a feedstock material for other applications. For example, the composite metal powder 10 may be used in the manufacture of lubricants and greases. Generally speaking, such applications will involve the use of copper/molybdenum disulfide composite powders 10 having higher levels or proportions of molybdenum disulfide. When used in the manufacture of lubricants and greases, the composite powder 10 may be used to increase the electrical and/or thermal conductivities of the resulting greases and lubricants.

A significant advantage of compacted articles 14 produced in accordance with the teachings of the present invention is that they are expected to exhibit high electrical and thermal conductivities in combination with low wear rates and low coefficients of friction compared to parts high in copper fabricated in accordance with conventional starting materials and methods. The compacted articles 14 of the present invention are also expected to form beneficial tribocouples with commonly-used metals and alloys, such as cast iron, steel, stainless steel, and tool steel. Therefore, compacted articles 14 of the present invention should be well-suited for use in a wide variety of applications where tribocouples having beneficial characteristics, such as lower friction and wear rates compared to conventionally available materials, would be desirable or advantageous.

In addition, compacted articles 14 according to the present invention may be fabricated with varying material properties and characteristics, such as density, elastic modulus, hardness, strength, ductility, toughness, friction coefficient and/or lubricity, thereby allowing compacted articles 14 to be tailored or engineered to specific requirements or applications. For example, compacted articles 14 having increased hardness and strength may be produced from copper/molybdenum disulfide composite powders 10 (i.e., feedstocks 26) having higher levels of copper and lower levels of molybdenum disulfide. Compacted articles 14 having such increased hardness and strength would be suitable for use as base structural materials, while still maintaining favorable tribocouple characteristics. Moreover, and as will be described in further detail herein, various other properties (e.g., density, elastic modulus, hardness, strength, ductility and/or toughness) of the compacted articles may be changed or varied by mixing the copper/molybdenum disulfide composite powder 10 with additional alloying agents, such as those mentioned herein.

Compacted articles 14 having increased lubricity and/or lower friction coefficients may be formed from composite powders (i.e., feedstocks 26) having higher concentrations of molybdenum disulfide. Compacted articles 14 having such increased lubricity may be advantageous for use in applications wherein transfer lubrication is to be provided by the compacted article 14, but where high structural strength and/or hardness may be of less importance.

Still other advantages are associated with the composite powder product 10 used as the feedstock 26 for the compacted articles 14. The copper/molybdenum disulfide composite powder product 10 disclosed herein provides a substantially homogeneous combination (i.e., even dispersion) of copper and molybdenum disulfide that is otherwise difficult or impossible to achieve by conventional methods. That is, even though the copper/molybdenum disulfide composite powder 10 comprises a powdered material, it is not a mere mixture of copper and molybdenum disulfide particles. Instead, the copper and molybdenum disulfide sub-particles are actually fused together, so that individual particles of the composite powder product 10 comprise both copper and molybdenum disulfide. Accordingly, powdered feedstocks 26 comprising the copper/molybdenum disulfide composite powders 10 according to the present invention should not separate (e.g., due to specific gravity differences) into copper particles and molybdenum disulfide particles.

Besides the advantages associated with the ability to provide a composite powder wherein copper and molybdenum disulfide are highly and evenly dispersed within one another (i.e., homogeneous), the composite powders 10 disclosed herein are expected to be characterized by high densities and flowabilities, thereby allowing the composite powders 10 to be used to advantage in a wide variety of powder compaction or consolidation processes, such as cold, warm, and hot isostatic pressing processes, as well as in axial pressing and sintering processes. The high flowabilities will allow the composite powders 10 to readily fill mold cavities, whereas the high densities will minimize any shrinkage that may occur during subsequent sintering processes.

Still yet other advantages are associated with the homogeneous distribution of copper and molybdenum disulfide in the composite powders 10. For example, in embodiments wherein the composite powder 10 is to be used in the manufacture of lubricants and greases, the substantially homogeneous distribution of copper and molybdenum disulfide within the composite powder 10 means that the beneficial properties of both components (e.g., copper and molybdenum disulfide) will remain homogeneous or evenly dispersed within the resulting lubricants and greases. Stated another way, lubricants and greases made from the composite powders 10 will have consistent properties, both on a volume basis and over time.

Having briefly described the copper/molybdenum disulfide composite powders 10, methods 12 for making the powders 10, compacted articles 14, and methods 13 for producing such compacted articles, various embodiments of the powders, processes and compacted articles will now be described in detail.

Referring back now to FIG. 1, a process or method 12 illustrated in FIG. 1 may be used to produce the copper/molybdenum disulfide composite powder 10. The resulting composite powder 10 may then be used as a feedstock material in a wide variety of processes to produce a wide variety of products, many of which are described herein and others of which will become apparent to persons having ordinary skill in the art after having become familiar with the teachings provided herein. Method 12 may comprise providing a supply of copper-containing powder 16 and a supply of molybdenum disulfide powder 18. The copper-containing powder 16 may comprise copper metal powder, copper oxide powders, such as copper (I) oxide ($Cu_2O$ or cuprous oxide), or copper (II) oxide (CuO or cupric oxide), and mixtures thereof. As will be described in further detail below, the use of a copper oxide powder in the copper-containing powder 16 may be beneficial in the removal of an organic binder in subsequent heat treating processes. More specifically, the oxygen from the copper oxide may help sweep out residual carbon remaining in the copper/molybdenum disulfide powder 10 after binder burn-out.

The copper-containing powder 16 may be provided in a wide range of particle sizes, depending on the type of powder used (e.g., metallic copper and/or copper oxide powders), as well as the particular process and/or equipment used to produce the copper/molybdenum disulfide powder product 10. For example, in many embodiments, the copper-containing powder 16 may have particle sizes in a range of about 50 μm to about 150 μm. However, in other embodiments, it may be advantageous to use smaller particle sizes, such as, for example, powders having particle sizes in a range of about 0.5 μm to about 1 μm. The use of smaller particle sizes may be desirable in embodiments wherein the copper-containing powders 16 might otherwise have a tendency to settle-out of the slurry 22, either during slurry formation or during subsequent spray drying of the slurry. However, such settling issues may be addressed by revising the pump design and/or configuration of the particular spray drying apparatus 24 that may be used to produce the copper/molybdenum disulfide composite powder product 10.

Still further, in embodiments wherein the copper-containing powder comprises metallic copper, either as the sole constituent or in combination with one or more copper oxides, the copper powder may comprise any of a wide range of copper powders obtained via conventional processes. Alternatively, the metallic copper powder may comprise a "dendritic" copper powder. Copper powders having a dendritic morphology are typically obtained by electro deposition processes. In any event, copper metal powders and copper oxide powders suitable for use in the present invention are commercially available from any of a wide range of suppliers and vendors. Dendritic copper powder is available from Freeport McMoRan Copper and Gold of Phoenix, Ariz.

The molybdenum disulfide powder 18 may comprise a molybdenum disulfide metal powder having a particle size in a range of about 0.1 μm to about 30 μm. Alternatively, molybdenum disulfide powders 18 having other sizes may also be used. Molybdenum disulfide powders 18 suitable for use in the present invention are commercially available from Climax Molybdenum Company, a Freeport-McMoRan Company, Ft. Madison Operations, Ft. Madison, Iowa (US). Suitable grades of molybdenum disulfide available from Climax Molybdenum Company include "technical," "technical fine," and "Superfine Molysulfide®" grades. By way of example, in one embodiment, the molybdenum disulfide powder 18 comprises the Superfine grade of molybdenum disulfide powder from Climax Molybdenum Company.

In one embodiment, the copper-containing powder 16 and molybdenum disulfide powder 18 may be mixed with a liquid 20 to form a slurry 22. Generally speaking, the liquid 20 may comprise deionized water, although other liquids, such as alcohols, volatile liquids, organic liquids, and various mixtures thereof, may also be used, as would become apparent to persons having ordinary skill in the art after having become familiar with the teachings provided herein. Consequently, the present invention should not be regarded as limited to the particular liquids 20 described herein. However, by way of example, in one embodiment, the liquid 20 comprises deionized water.

In addition to the liquid 20, a binder 40 may be used, although the addition of a binder 40 is not required. Binders 40 suitable for use in the present invention include, but are not limited to, polyvinyl alcohol (PVA). The binder 40 may be mixed with the liquid 20 before adding the copper metal powder 16 and the molybdenum disulfide powder 18. Alternatively, the binder 40 could be added to the slurry 22, i.e., after the copper-containing powder 16 and molybdenum disulfide powder 18 have been combined with liquid 20.

The slurry 22 may comprise from about 15% to about 50% by weight total liquid (about 21% by weight total liquid typical) (e.g., either liquid 20 alone, or liquid 20 combined with binder 40), with the balance comprising the copper-containing metal powder 16 and the molybdenum disulfide powder 18 in the proportions described below.

As described above, certain properties or material characteristics of the composite powders 10 and or products made therefrom (e.g., compacted article 14, lubricants, and greases) may be varied or adjusted by changing the relative proportions of copper and molybdenum disulfide in the composite powder 10. Generally speaking, the structural strength of the compacted articles 14 may be increased by decreasing the concentration of molybdenum disulfide in the composite powder 10. Similarly, the lubricity of the compacted articles 14 may be increased by increasing the concentration of molybdenum disulfide in the composite powder 10.

Additional factors that may affect the amount of molybdenum disulfide powder 18 that is to be provided in slurry 22 include, but are not limited to, the particular "downstream" processes that may be employed in the manufacture of the compacted article 14. For example, certain downstream processes, such as heating and sintering processes, may result in some loss of molybdenum disulfide in the final compacted article 14, which may be compensated by providing additional amounts of molybdenum disulfide in the slurry 22. Still other additional factors include whether the composite powder 10 is to be used in the manufacture of lubricants and greases, in which case the copper/molybdenum disulfide composite metal powder 10 will generally comprise primarily molybdenum disulfide with smaller amounts of copper.

Consequently, the amount of molybdenum disulfide powder 18 that may be used to form the slurry 22 may be varied or adjusted to provide the composite powder 10 and/or final compacted article 14 with the desired amount of "retained" molybdenum disulfide (i.e., to provide the compacted article 14 with the desired strength and lubricity). Furthermore, because the amount of retained molybdenum disulfide may vary depending on a wide range of factors, many of which are described herein and others of which would become apparent to persons having ordinary skill in the art after having become familiar with the teachings provided herein, the present invention should not be regarded as limited to the provision of the molybdenum disulfide powder 18 in any particular amounts.

By way of example, the mixture of copper-containing powder 16 and molybdenum disulfide powder 18 may comprise from about 5% by weight to about 95% by weight copper-containing powder 16 (i.e., from about 95% by weight to about 5% by weight molybdenum disulfide powder 18). It should be noted that these weight percentages are exclusive of the liquid component(s) later added to form the slurry 22. That is, these weight percentages refer only to the relative quantities of the powder components 16 and 18.

Overall, then, slurry 22 may comprise from about 15% by weight to about 50% by weight liquid 20 (about 18% by weight typical), which may include from about 0% by weight (i.e., no binder) to about 10% by weight binder 40 (about 3% by weight typical). The balance of slurry 22 may comprise the metal powders (e.g., copper-containing powder 16 and molybdenum disulfide powder 18) in the proportions specified herein.

Depending on the particular application for the compacted article 14, it may be desirable to add a supplemental metal powder 42 to the slurry 22. See FIG. 1. Generally speaking, the addition of a supplemental metal powder 42 may be used to change or vary other material properties of the resulting compacted article 14, which may be desired or required for the particular application. Exemplary supplemental metal powders 42 include, but are not limited to, nickel, tin, lead, zinc, and beryllium powders and mixtures thereof.

If used, the supplemental metal powder 42 may be added to the slurry 22, as best seen in FIG. 1. Alternatively, supplemental metal powder 42 may be added to the composite powder product 10 (i.e., after spray drying). However, it will be generally preferred to add the supplemental metal powder 42 to the slurry 22.

After being prepared, slurry 22 may be spray dried (e.g., in spray dryer 24) to produce the composite powder product 10. By way of example, in one embodiment, the slurry 22 is spray dried in a pulse combustion spray dryer 24 of the type shown and described in U.S. Patent No. 7,470,307, of Larink, Jr., entitled "Metal Powders and Methods for Producing the Same," which is specifically incorporated herein by reference for all that it discloses.

In one embodiment, the spray dry process involves feeding the slurry 22 into the pulse combustion spray dryer 24. In the spray dryer 24, slurry 22 impinges a stream of hot gas (or gases) 44, which are pulsed at or near sonic speeds. The sonic pulses of hot gas 44 contact the slurry 22 and drive-off substantially all of the liquid (e.g., water and/or binder) to form the composite powder product 10. The temperature of the pulsating stream of hot gas 44 may be in a range of about 300° C. to about 800° C., such as about 465° C. to about 537° C., and more preferably about 565° C.

Figure 3:
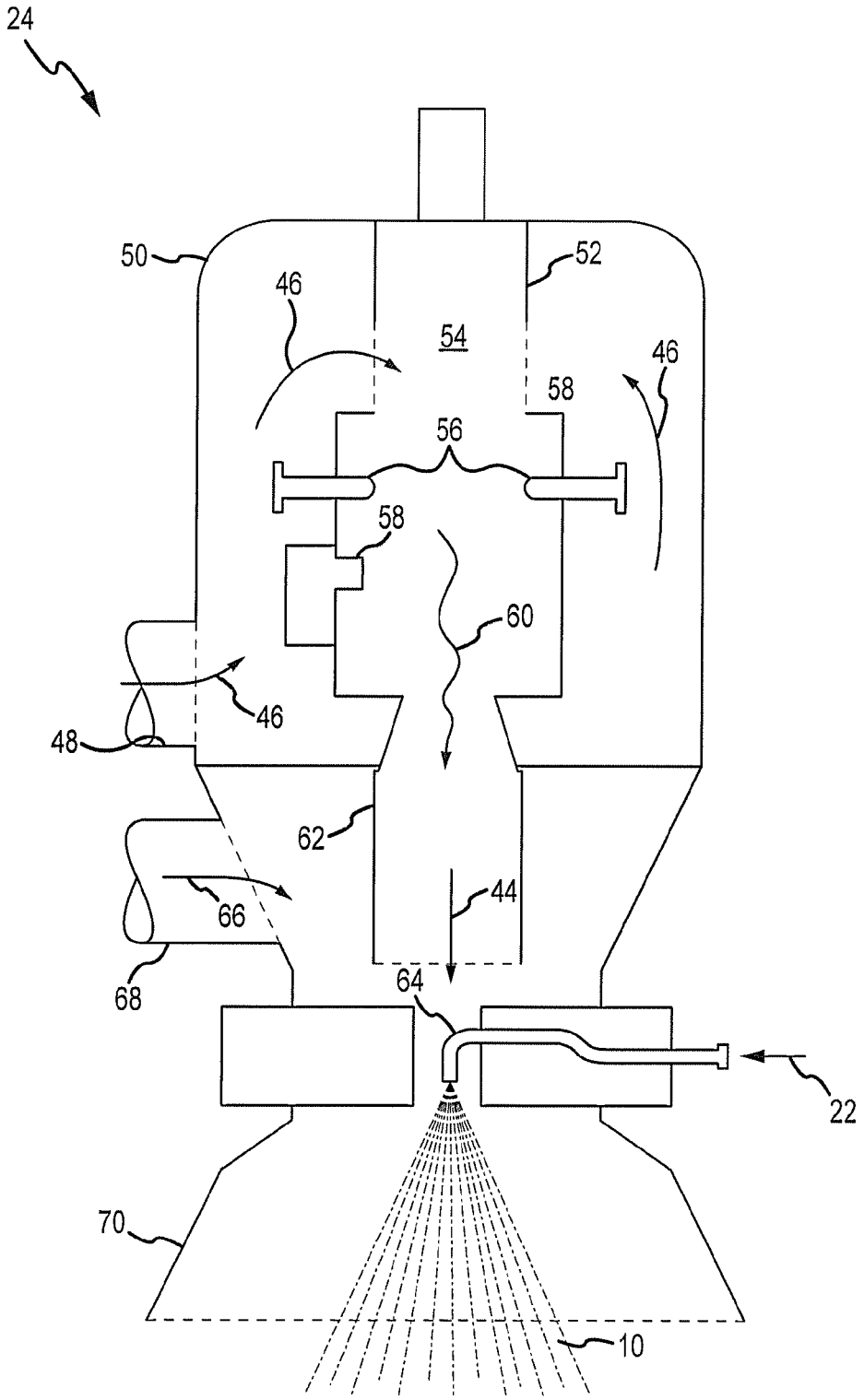
FIG. 3 is a schematic representation of one embodiment of a pulse combustion spray dry apparatus that may be used to produce the copper/molybdenum disulfide composite powder.

More specifically, and with reference now primarily to FIG. 3, combustion air 46 may be fed (e.g., pumped) through an inlet 48 of spray dryer 24 into the outer shell 50 at low pressure, whereupon it flows through a unidirectional air valve 52. The air 46 then enters a tuned combustion chamber 54 where fuel is added via fuel valves or ports 56. The fuel-air mixture is then ignited by a pilot 58, creating a pulsating stream of hot combustion gases 60 which may be pressurized to a variety of pressures, e.g., in a range of about 0.003 MPa (about 0.5 psi) to about 0.2 MPa (about 3 psi) above the combustion fan pressure. The pulsating stream of hot combustion gases 60 rushes down tailpipe 62 toward the atomizer 64. Just above the atomizer 64, quench air 66 may be fed through an inlet 68 and may be blended with the hot combustion gases 60 in order to attain a pulsating stream of hot gases 44 having the desired temperature. The slurry 22 is introduced into the pulsating stream of hot gases 44 via the atomizer 64. The atomized slurry may then disperse in the conical outlet 70 and thereafter enter a conventional tall-form drying chamber (not shown). Further downstream, the copper/molybdenum disulfide composite powder product 10 may be recovered using standard collection equipment, such as cyclones and/or baghouses (also not shown).

In pulsed operation, the air valve 52 is cycled open and closed to alternately let air into the combustion chamber 54 for the combustion thereof. In such cycling, the air valve 52 may be reopened for a subsequent pulse just after the previous combustion episode. The reopening then allows a subsequent air charge (e.g., combustion air 46) to enter. The fuel valve 56 then re-admits fuel, and the mixture auto-ignites in the combustion chamber 54, as described above. This cycle of opening and closing the air valve 52 and combusting the fuel in the chamber 54 in a pulsing fashion may be controllable at various frequencies, e.g., from about 80 Hz to about 110 Hz, although other frequencies may also be used.

The "green" copper/molybdenum disulfide composite powder product 10 produced by the pulse combustion spray dryer described herein comprises a plurality of generally spherically-shaped particles that are themselves agglomerations of smaller particles, as best seen in FIGS. 4(*a*), 5(*a*), and 6(*a*). As already described, the copper and molybdenum disulfide are highly dispersed within one another, so that the composite powder 10 comprises a substantially homogeneous dispersion or composite mixture of molybdenum disulfide and copper sub-particles that are fused together.

For example, and with reference now to FIGS. 4(*a-e*), powder produced by the Trial 1 embodiment (e.g., made from a slurry 22 comprising about 5 wt. % copper and 95 wt. % molybdenum disulfide) is characterized by substantially spherical particles that are agglomerations of sub-particles. The copper and molybdenum disulfide are highly and evenly dispersed within one another (i.e., homogeneous), as clearly indicated by the EDS spectral map for sulfur, FIG. 4(*b*), molybdenum, FIG. 4(*c*), and copper, FIG. 4(*d*). The EDS spectral map shown in FIG. 4(*e*) shows characteristic peaks consistent with the formulation of the Trial 1 embodiment.

The powders produced by the Trials 3 and 4 embodiments (i.e., made from slurries 22 comprising 50/50 wt. % $Cu/MoS_2$, and 95/5 wt. % $Cu/MoS_2$, respectively) display morphologies are substantially identical to the powders of the Trial 1 embodiment, with the exception of the relative amounts of copper and molybdenum disulfide contained in the powders. See FIGS. 5(*a-c*) and 6(*a-c*).

Depending on the particular spray drying parameters used, copper/molybdenum disulfide composite powder products 10 produced in accordance with the teachings provided herein may be produced in a wide range of sizes, and particles having sizes ranging from about 1 μm to about 500 μm, such as, for example, sizes ranging from about 1 μm to about 100 μm, may be readily produced by the following the teachings provided herein. The composite powder product 10 may be classified e.g., at step 28 (FIG. 2), if desired, to provide a product 10 having a more narrow size range.

As mentioned above, the copper/molybdenum disulfide composite powder 10 is also expected to be of high density and should be quite flowable. Exemplary composite powder products are expected to have Scott densities (i.e., apparent densities) in a range of about 0.9 g/cc to about 1.2 g/cc. Hall flowabilities are expected to be in the range of about 50 s/50 g to about 150 s/50 g In some embodiments, Hall flowabilities may be even lower (i.e., more flowable).

As already described, the pulse combustion spray dryer 24 provides a pulsating stream of hot gases 44 into which is fed the slurry 22. The contact zone and contact time are very short, the time of contact often being on the order of a fraction of a microsecond. Thus, the physical interactions of hot gases 44, sonic waves, and slurry 22 produces the composite powder product 10. More specifically, the liquid component 20 of slurry 22 is substantially removed or driven away by the sonic (or near sonic) pulse waves of hot gas 44. The short contact time also ensures that the slurry components are minimally heated, e.g., to levels on the order of about 115° C. at the end of the contact time, temperatures which are sufficient to evaporate the liquid component 20.

However, in certain instances, residual amounts of liquid (e.g., liquid 20 and/or binder 40, if used) may remain in the resulting "green" composite powder product 10. Any remaining liquid 20 may be driven-off (e.g., partially or entirely), by a subsequent heating process or step 30. See FIG. 2. Generally speaking, the heating process 30 should be conducted at moderate temperatures in order to drive off the liquid components, but not substantial quantities of molybdenum disulfide. Some molybdenum disulfide may be lost during heating 30, which may result in a corresponding reduction in the amount of retained molybdenum disulfide in the heated feedstock product 26. As a result, it may be necessary to provide increased quantities of molybdenum disulfide powder 18 to compensate for any expected loss, as described above.

As mentioned earlier, if a binder 40 is to be used, and if it is desired to ensure that all of the binder 40 is driven off by heating step 30, it may be desirable or advantageous to provide the copper-containing powder 16 with at least some amount of copper oxide powder, e.g., either copper (I) oxide, $Cu_2O$, copper (II) oxide, CuO, and/or mixtures thereof. Upon heating 30, the oxygen in the copper oxide will aid in removing or sweeping out residual amounts of carbon and/or other oxidizable constituents of binder 40. However, the use of copper oxides in the copper-containing powder 16 is not required.

Heating 30 may be conducted at temperatures within a range of about 90° C. to about 120° C. (about 110° C. preferred). Alternatively, temperatures as high as 300° C. may be used for short periods of time. However, such higher temperatures may reduce the amount of retained molybdenum disulfide in the final metal product 14. In many cases, it may be preferable to conduct the heating 30 in a hydrogen atmosphere in order to minimize oxidation of the composite powder 10.

It may also be noted that the agglomerations of the metal powder product 10 preferably retain their shapes (in many cases, substantially spherical), even after the heating step 30. In fact, heating 30 may, in certain embodiments, result in an increase in flowability of the composite powder 10.

As noted above, in some instances a variety of sizes of agglomerated particles comprising the composite powder 10 may be produced during the spray drying process. It may be desirable to further separate or classify the composite powder product 10 into a powder product having a size range within a desired product size range. For example, it is expected that most of the composite powder 10 produced will comprise particle sizes in a wide range (e.g., from about 1 μm to about 500 μm), with substantial amounts (e.g., in a range of 40-50 wt. %) of product being smaller than about 45 μm (i.e., −325 U.S. mesh). Significant amounts of composite powder 10 (e.g., in a range of 30-40 wt. %) may be in the range of about 45 μm to 75 μm (i.e., −200+325 U.S. mesh).

The processes described herein are expected to yield a substantial percentage of product in this product size range; however, there may be remainder products, particularly the smaller products, outside the desired product size range which may be recycled through the system, though liquid (e.g., water) would again have to be added to create an appropriate slurry composition. Such recycling is an optional alternative (or additional) step or steps.

Once the copper/molybdenum disulfide composite powder 10 has been prepared, it may be used as a feedstock material 26 in a process 13 illustrated in FIG. 2 to produce a compacted article 14. In such a process 13, the feedstock material 26 may comprise a "green" copper/molybdenum disulfide composite powder 10, i.e., substantially as produced by method 12 of FIG. 1. Alternatively, the green copper/molybdenum disulfide composite powder 10 may be classified, e.g., at step 28, to tailor the distribution of particle sizes of the feedstock material 26 to a desired size or range of sizes.

Generally speaking, composite powders 10 suitable for the exemplary uses described herein may comprise any of a wide range of particle sizes and mixtures of particle sizes, so long as the particle sizes allow the composite powder 10 to be compressed (e.g., by the processes described herein) to achieve the desired material characteristics (e.g., strength and/or density) desired for the final compacted article or compact 14. Generally speaking, it is expected that acceptable results can be obtained with powder sizes in the following ranges:

TABLE I

| Mesh Size | Weight Percent |
|---|---|
| +200 | 10%-40% |
| −200/+325 | 25%-45% |
| −325 | 25%-55% |

As mentioned above, it may be desirable or advantageous to classify the green composite powder 10 before it is consolidated at step 32. Factors to be considered include, but are not limited to, the particular compacted article 14 that is to be produced, the desired or required material characteristics of the compacted article (e.g., density, hardness, strength, toughness, etc.) as well as the particular consolidation process 32 that is to be used.

The desirability and/or necessity to first classify the green composite powder 10 will also depend on the particular particle sizes of the green composite powder 10 produced by the process 12 of FIG. 1. That is, depending on the particular process parameters that are used to produce the green composite powder 10 (examples of which are described herein), it may be possible or even advantageous to use the composite powder 10 in its green form. Alternatively, of course, other considerations may indicate the desirability of first classifying the green composite powder 10.

In summation, then, because the desirability and/or necessity of classifying the composite powder 10 will depend on a wide variety of factors and considerations, some of which are described herein and others of which will become apparent to persons having ordinary skill in the art after having become familiar with the teachings provided herein, the present invention should not be regarded as requiring a classification step 28.

The composite powder 10 may also be heated, e.g., at step 30, if required or desired. Such heating 30 of the composite powder 10 may be used to remove any residual moisture and/or volatile material that may remain in the composite powder 10. In some instances, heating 30 of the composite powder 10 may also have the beneficial effect of increasing the flowability of the composite powder 10.

The feedstock material 26 (i.e., comprising either the green composite powder product 10 or a heated/classified powder product) may then be compacted or consolidated at step 32 to produce the desired compacted article 14 or a "blank" compact from which the desired compacted article 14 may be produced. Consolidation processes 32 that may be used with the present invention include, but are not limited to, axial pressing, hot isostatic pressing (HIPing), warm isostatic pressing (WIPing), cold isostatic pressing (CIPing), and sintering.

Generally speaking, composite powders 10 prepared in accordance with the teachings provided herein may be consolidated so that the resulting "green" compacted articles or compacts 14 will have green densities in a range of about 4.3 g/cc to about 6.4 g/cc (about 5 g/cc, typical), depending on the relative proportions of copper involved in the slurry 22. For example, compacted articles comprising lower amounts of copper (e.g., about 5 wt. % Cu) generally will have lower green densities (e.g., about 4.3 g/cc), whereas compacted articles comprising higher amounts of copper (e.g., about 95 wt. % Cu) generally will have higher green densities (e.g., about 6.4 g/cc).

Axial pressing may be performed at a wide range of pressures depending on a variety of factors, including the size and shape of the particular compacted article or compact 14 that is to be produced as well as on the strength and/or density desired for the compacted article or compact 14. Consequently, the present invention should not be regarded as limited to any particular compaction pressure or range of compaction pressures. However, by way of example, in one embodiment, when compressed under a pressure in the range of about 310 MPa to about 470 MPa (about 390 MPa preferred), composite powders 10 prepared in accordance with the teachings provided herein will acquire green strengths and densities in the ranges described herein.

Cold, warm, and hot isostatic pressing processes involve the application of considerable pressure and heat (in the cases of warm and hot isostatic pressing) in order to consolidate or form the composite powder feedstock material 26 into the desired shape. Generally speaking, pressures for cold, warm and hot isostatic processes should be selected so as to provide the resulting compacts with green densities in the ranges specified herein.

Hot isostatic pressing processes may be conducted at the pressures specified herein and at any of a range of suitable temperatures, again depending on the green density of the copper/molybdenum disulfide composite powder compact. However, it should be noted that some amount of molybdenum disulfide may be lost at higher temperatures and/or processing times. Consequently, the temperatures may need to be moderated to ensure that the final compacted article or compact 14 contains the desired quantity of retained molybdenum disulfide.

Warm isostatic pressing processes may be conducted at the pressures specified herein. Temperatures for warm isostatic pressing will generally be below temperatures for hot isostatic pressing.

Sintering may be conducted at any of a range of temperatures. The particular temperatures that may be used for sintering will depend on a variety of factors, including the desired density for the final compacted article 14, as well as amount of molybdenum disulfide that is desired to be retained in the compacted article or compact 14.

After consolidation 32, the resulting metal product 14 (e.g., slip ring 34) may be used "as is" or may be further processed if required or desired. For example, the metal product 14 may be machined at step 36 if necessary or desired before being placed in service. Metal product 14 may also be heated or sintered at step 38 in order to further increase the density and/or strength of the metal product 14. It may be desirable to conduct such a sintering process 38 in a hydrogen atmosphere in order to minimize the likelihood that the metal product 14 will become oxidized. Generally speaking, it will be preferred to conduct such heating at temperatures sufficiently low so as to avoid substantial reductions in the amount of retained molybdenum disulfide in the final product.

Generally speaking, it will be preferred, but not necessarily required, to produce the copper/molybdenum disulfide powder product 10 using the spray drying processes shown and described herein. Such spray drying processes will result in the formation of copper/molybdenum disulfide powder products having the morphologies and substantially homogeneous compositions described herein. However, it may be possible or desirable in certain situations to use one or more types of granulation processes to produce a granulated copper/molybdenum disulfide powder. Generally speaking, granulation is a process in which primary powder particles (e.g., the copper-containing powder 16 and the molybdenum disulfide powder 18) are made to adhere to form larger, multi-particle entities called granules. Most granulation processes will not result in the production of a highly spherical powder product, at least in comparison with the spray drying processes described herein. However, a granulated copper/molybdenum disulfide powder may be acceptable for use in certain applications.

In one such alternate embodiment, a dry granulation process may be used to produce a granulated copper/molybdenum disulfide powder product. The dry granulation process may involve the dry mixing or blending of the copper-containing powder 16 and the molybdenum disulfide powder 18. The powders may be added in the various proportions described herein (e.g., from about 5 wt. % copper to about 95 wt. % copper). The resulting dry powder blend may then be compacted (e.g., by passing it through a tableting press or between two rollers). The compacted powder may then be broken-up into smaller particles, if desired.

In another embodiment a wet granulation process may be used. The wet granulation process may involve the mixing or blending of the copper-containing powder 16 and the molybdenum disulfide powder 18 with a suitable granulating fluid (not shown) in a process known as "wet massing." The resulting wet mass is then dried to produce the resulting granulated product.

Powder Examples

Four (4) different slurry compositions ("compositions 1-4") were prepared containing different proportions of copper-containing powder 16 and molybdenum disulfide powder 18, as shown in Table II. The resulting slurry compositions were then spray dried in four corresponding spray dry trials ("Trials 1-4") to produce four different powder compositions or embodiments. The various powder compositions were then analyzed by energy dispersive x-ray spectroscopy (EDS) to determine the compositional make-up of the powder compositions as well as the degree to which the various components (e.g., Cu and $MoS_2$) were dispersed within the composite powder, as indicated by the EDS spectral maps referenced in Table III. Scanning electron micrographs were also produced from the powders of Trials 1, 3, and 4, as also referenced in Table III. An EDS assay of the powder produced by Trial 3 is presented in Table IV.

More specifically, the four (4) slurry compositions were prepared by mixing copper metal powder and molybdenum disulfide powder in the proportions specified in Table II. The copper containing powder 16 comprised a conventional, i.e., non-dendritic metallic copper powder of the type specified herein and having a particle size of −325 Tyler mesh (i.e., less than about 44 μm). The molybdenum disulfide powder 18 comprised a Superfine grade of molybdenum disulfide powder, having a mean particle size specification of 0.5-1 μm, as specified herein. The copper-containing powder 16 and molybdenum disulfide powder 18 were combined with water to form a slurry 22. No binder 40 was used.

TABLE II

| Slurry Composition | Copper Powder (wt. %) | Molybdenum Disulfide Powder (wt. %) |
|---|---|---|
| 1 | 5 | 95 |
| 2 | 25 | 75 |
| 3 | 50 | 50 |
| 4 | 95 | 5 |

After being prepared, the slurries 22 were then fed into the pulse combustion spray drying system 24 in the manner described herein. The temperature of the pulsating stream of hot gases 44 may be controlled to be within a range of about 300° C. to about 800° C., and more preferably between about 465° C. to about 537° C. The pulsating stream of hot gases 44 produced by the pulse combustion system 24 will substantially drive off the water from the slurry 22 to form the composite powder product 10.

The resulting metal powder products 10 from the various spray dry trials were then imaged by scanning electron microscopy (SEM) and analyzed by energy dispersive x-ray spectroscopy. The SEM micrographs for the powder products produced by the corresponding trials are referenced in Table III. Similarly, the resulting EDS maps and spectra for the corresponding trials are also referenced in Table III. The SEM micrographs confirm that the powders produced from the various slurry compositions resulted in substantially spherical particles that are themselves agglomerations of smaller sub-particles. Similarly, the EDS maps confirm that the copper and molybdenum disulfide are substantially evenly dispersed, with each particle containing approximately the same proportions of copper and molybdenum disulfide. No SEM micrographs or EDS maps of the powder product produced in Trial 2 are provided. However, an EDS assay analysis of the powder produced by Trial 3 is presented in Table IV.

TABLE III

Figure 5B:
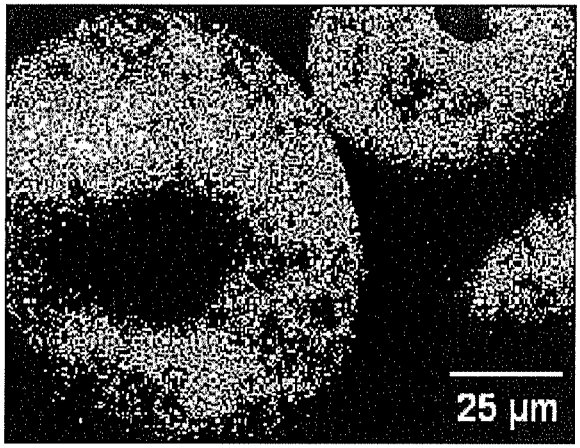
FIG. 5*b* is a spectral map produced by energy dispersive x-ray spectroscopy showing the dispersion of molybdenum in the image of FIG. 5*a;*
Figure 5C:
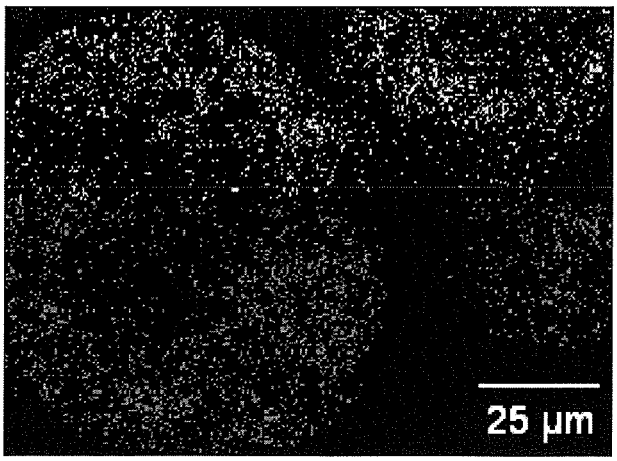
FIG. 5*c* is a spectral map produced by energy dispersive x-ray spectroscopy showing the dispersion of copper in the image of FIG. 5*a;*
Figure 5D:
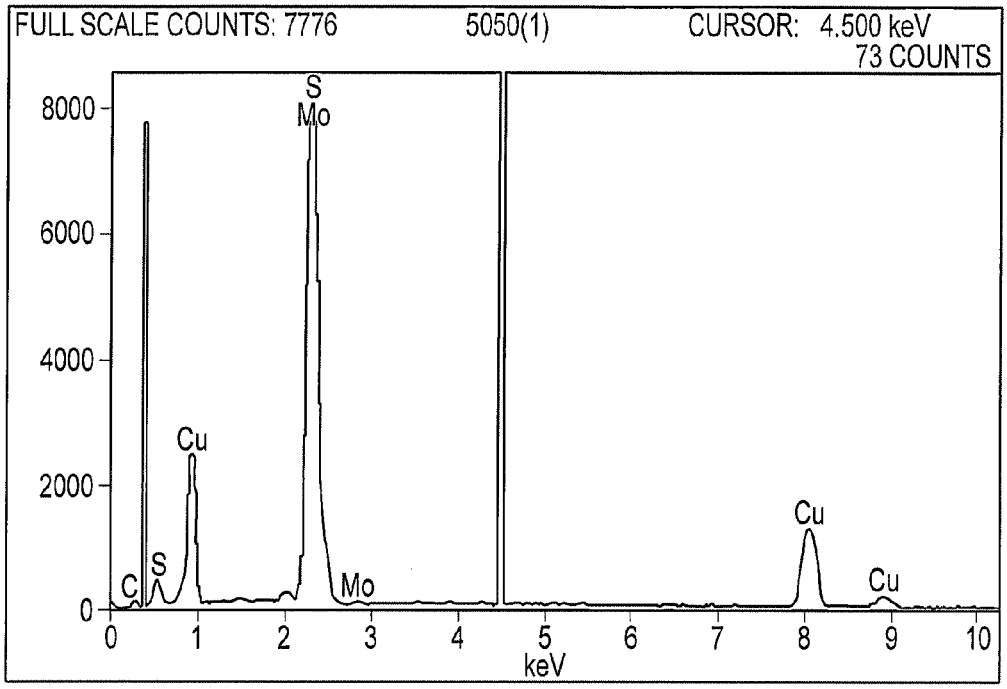
FIG. 5*d* is a spectrum produced by energy dispersive x-ray spectroscopy showing various characteristic peaks associated with elements of the powder sample shown in FIGS. 5*a-c;*
Figure 6B:
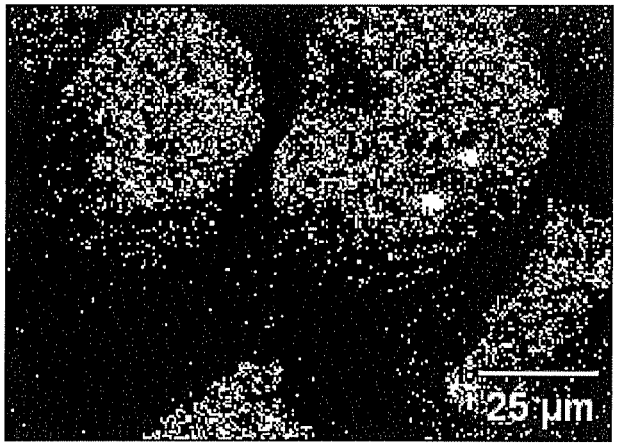
FIG. 6*b* is a spectral map produced by energy dispersive x-ray spectroscopy showing the dispersion of molybdenum in the image of FIG. 6*a;*
Figure 6C:
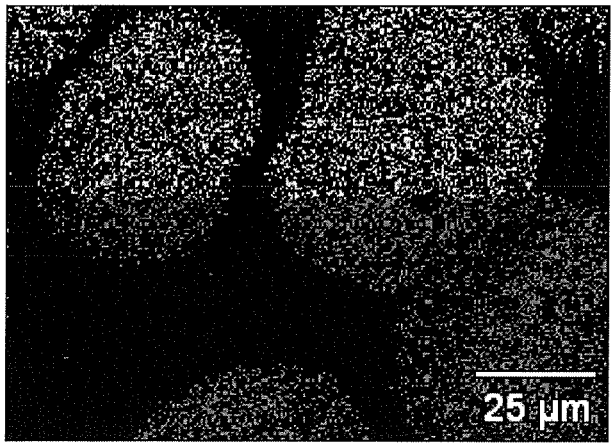
FIG. 6*c* is a spectral map produced by energy dispersive x-ray spectroscopy showing the dispersion of copper in the image of FIG. 6*a*.
Figure 6D:
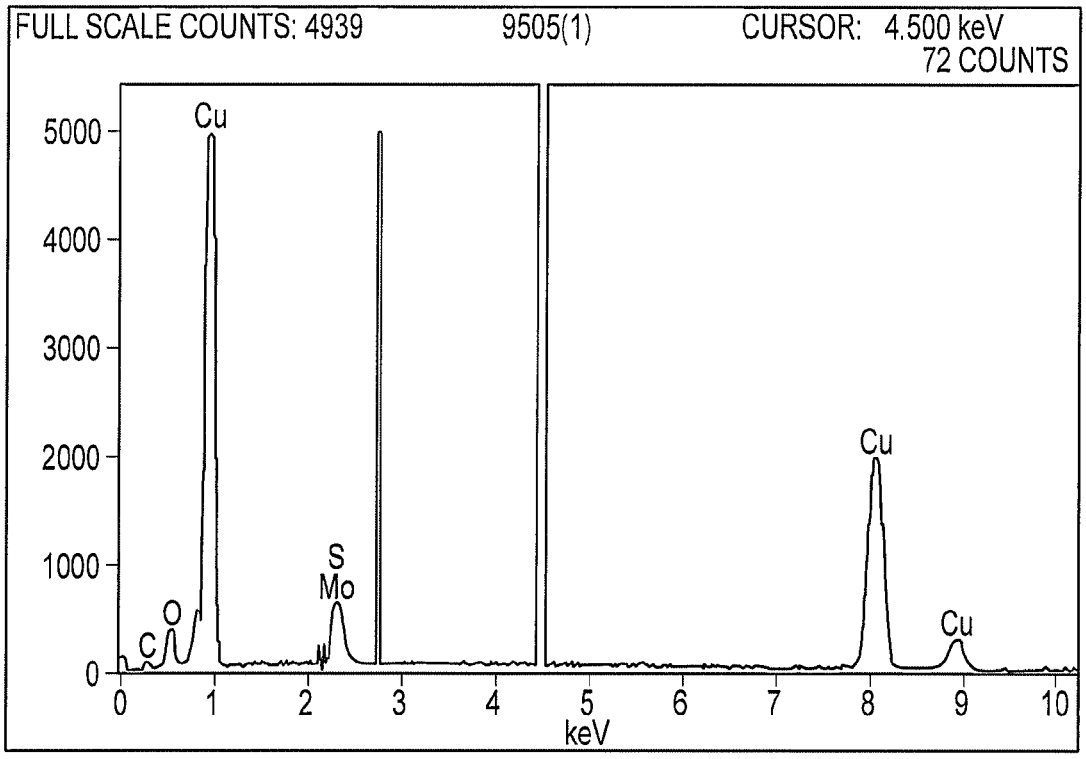
FIG. 6*d* is a spectrum produced by energy dispersive x-ray spectroscopy showing various characteristic peaks associated with elements of the powder sample shown in FIGS. 6*a-c*.

| Trial | SEM | EDS Map (Sulfur) | EDS Map (Molybdenum) | EDS Map (Copper) | EDS Spectra |
|---|---|---|---|---|---|
| 1 | FIG. 4a | FIG. 4b | FIG. 4c | FIG. 4d | FIG. 4e |
| 2 | — | — | — | — | — |
| 3 | FIG. 5a | — | FIG. 5b | FIG. 5c | FIG. 5d |
| 4 | FIG. 6a | — | FIG. 6b | FIG. 6c | FIG. 6d |

TABLE IV

| Element Line | Element Amount (wt. %) | Error |
|---|---|---|
| C K | 2.66 | ±0.09 |
| Cu K | 25.31 | ±0.32 |
| Cu L | — | — |
| Mo L | 72.03 | ±0.39 |
| Mo K | — | — |
| Mo M | — | — |

The EDS assay analysis of the Trial 3 embodiment (i.e., made from a slurry 22 comprising about 50/50 wt. % $Cu/MoS_2$) confirmed a substantial loss of copper in the final powder product 10 compared to what was in the slurry 22. However, in that particular trial, it was discovered that substantial amounts of the copper powder 16 settled out in the various slurry pumping apparatus and fluid conduits of the spray dryer 24. It should be possible to resolve this problem by suitable re-design/re-configuration of the pumping apparatus and fluid conduit system of the spray dryer 24.

Prophetic Compacted Article Examples

Various types of compacted articles 14 may be produced or made from the copper/molybdenum disulfide composite powders 10 produced by the spray dry process 12 illustrated in FIG. 1. By way of example, a compacted article 14 may comprise a slip ring 34 of the type commonly used in electrical generating equipment. A preformed compacted article may be formed from a "green" copper/molybdenum disulfide composite powder 10 screened so that the particle size is less than about 105 μm (−150 Tyler mesh). In one embodiment, the preformed compacted article may be formed by a uniaxial pressing process in which the copper/molybdenum disulfide composite powder 10 pressed under a uniaxial pressure in a range of about 225 MPa (about 16.5 tsi) to about 275 MPa (about 20 tsi) so that the compacted article behaves as a nearly solid mass. Thereafter, the preformed compacted article may be placed in a sealed container for additional compaction via a wide range of compaction processes, such as cold-, warm-, and hot-isostatic pressing. Alternatively, the preformed compacted article could be sintered.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A compacted article comprising a copper/molybdenum disulfide composite powder compressed under sufficient pressure to cause said copper/molybdenum disulfide composite powder to behave as a nearly solid mass, said copper/molybdenum disulfide composite powder comprising a substantially homogeneous dispersion of copper and molybdenum disulfide sub-particles that are fused together to form individual substantially spherical particles of said composite powder.

2. The compacted article of claim 1, having a green density in a range of about 4.3 g/cc to about 6.4 g/cc.

3. The compacted article of claim 1, having a green density of about 5 g/cc.

4. The compacted article of claim 1, having a friction coefficient in a range of about 0.2 to 0.7.

5. The compacted article of claim 1, having a copper content in a range of about 5% by weight to about 95% by weight.

6. A compacted article consisting essentially of a copper/molybdenum disulfide composite powder comprising a substantially homogeneous dispersion of substantially spherical copper and molybdenum disulfide sub-particles that are fused together to form individual substantially spherical particles of said composite powder compressed under sufficient pressure to cause copper/molybdenum disulfide composite powder to behave as a nearly solid mass.

7. A method of producing a compacted article, comprising:

providing a copper/molybdenum disulfide composite powder comprising a substantially homogeneous dispersion of copper and molybdenum disulfide sub-particles that are fused together to form individual substantially spherical particles of said copper/molybdenum disulfide composite powder; and compressing said copper/molybdenum disulfide composite powder under sufficient pressure to cause said copper/molybdenum disulfide composite powder to behave as a nearly solid mass.

8. The method of claim 7, wherein said compressing comprises axial pressing.

9. The method of claim 8, wherein said axial pressing comprises applying a pressure of about 240 MPa.

10. The method of claim 7, wherein said compressing comprises one or more selected from the group consisting of cold isostatic pressing, warm isostatic pressing, and hot isostatic pressing.

11. The method of claim 7, further comprising sintering after said compressing.

12. The method of claim 7, further wherein said compressing comprises hot isostatic pressing.

13. The method of claim 7, wherein said compressing imparts to said compacted article a green density in a range of about 4.3 g/cc to about 6.4 g/cc.

14. The method of claim 7, wherein said compressing imparts to said compacted article a green density of about 5 g/cc.

15. The method of claim 7, wherein providing a supply of copper/molybdenum disulfide composite powder comprises:

providing a supply of copper-containing powder;

providing a supply of molybdenum disulfide powder;

combining said copper-containing powder and said molybdenum disulfide powder with a liquid to form a slurry;

feeding said slurry into a stream of hot gas; and recovering the copper/molybdenum disulfide composite powder.

16. The method of claim 15, wherein feeding said slurry into a stream of hot gas comprises atomizing said slurry and contacting said atomized slurry with the stream of hot gas.

17. The method of claim 15, wherein combining said copper-containing powder and said molybdenum disulfide powder with a liquid comprises combining said copper-containing powder and said molybdenum disulfide powder with water to form a slurry.

18. The method of claim 15, wherein said slurry comprises between about 15 percent by weight to about 50 percent by weight liquid.

19. The method of claim 15, further comprising:

providing a supply of a binder material; and combining said binder material with said copper-containing powder, said molybdenum disulfide powder, and said water to form a slurry.

20. The method of claim 19, wherein said binder comprises polyvinyl alcohol.

21. The method of claim 19, wherein said supply of copper-containing powder is added to said supply of molybdenum disulfide powder in amounts ranging from about 5% by weight to about 95% by weight before combining said supply of copper-containing powder and said supply of molybdenum disulfide with said liquid to form said slurry.

22. The method of claim 19, further comprising heating the recovered copper/molybdenum disulfide composite powder at a temperature sufficient to drive-off substantially all of said binder.

23. The method of claim 22, wherein said heating further comprises heating in a hydrogen atmosphere.

24. The method of claim 23, wherein said heating in a hydrogen atmosphere is conducted at a temperature in a range of about 500° C. to about 825° C.

25. The method of claim 7, further comprising sintering after said compressing.

26. The method of claim 15, wherein providing a supply of copper-containing powder comprises providing a supply of copper-containing powder selected from the group consisting essentially of metallic copper powder, copper (I) oxide (cuprous oxide) powder, and copper (II) oxide (cupric oxide) powder.

27. A method of producing a copper/molybdenum disulfide composite powder, comprising:

providing a supply of copper metal powder;

providing a supply of molybdenum disulfide powder;

combining said copper metal powder and said molybdenum disulfide powder with a liquid to form a slurry;

feeding said slurry into a stream of hot gas; and recovering the copper/molybdenum disulfide composite powder, said copper/molybdenum disulfide composite powder comprising a substantially homogeneous dispersion of copper and molybdenum disulfide sub-particles that are fused together to form individual substantially spherical particles of said copper/molybdenum disulfide composite powder.

28. A copper/molybdenum disulfide composite powder comprising a substantially homogeneous dispersion of copper and molybdenum disulfide sub-particles that are fused together to form individual substantially spherical particles of said copper/molybdenum disulfide composite powder.

29. The copper/molybdenum disulfide composite powder of claim 28 comprising a Hall flowability in a range of about 50 seconds for 50 grams to about 150 seconds for 50 grams.

30. The copper/molybdenum disulfide composite powder of claim 28 having a Scott density in a range of about 0.9 g/cc to about 1.2 g/cc.

31. The copper/molybdenum disulfide composite powder of claim 28, comprising from about 5% by weight to about 95% by weight copper.

32. The copper/molybdenum disulfide composite powder of claim 28 wherein said individual particles comprising said copper/molybdenum disulfide composite powder product have sizes in a range of about 1 μm to about 500 μm.

33. The copper/molybdenum disulfide composite powder of claim 32 wherein said individual particles comprising said copper/molybdenum disulfide composite powder product have sizes in a range of about 1 μm to about 100 μm.

34. The copper/molybdenum disulfide composite powder of claim 32 wherein said individual particles comprising said copper/molybdenum disulfide composite powder product have sizes in a range of about 45 μm to about 75 μm.

35. A method of producing a compacted metal article, comprising:

providing a granulated copper/molybdenum disulfide powder comprising a substantially homogeneous dispersion of copper and molybdenum disulfide sub-particles that are aggregated together to form individual substantially spherical particles of said granulated copper molybdenum disulfide powder; and compressing said granulated copper/molybdenum disulfide powder under sufficient pressure to cause said granulated copper/molybdenum disulfide powder to behave as a nearly solid mass.

36. The method of claim 35, wherein said providing a supply of granulated copper/molybdenum disulfide powder further comprises:

providing a supply of a copper-containing powder;

providing a supply of molybdenum disulfide powder;

mixing together the copper-containing powder and the molybdenum disulfide powder to form a blended powder mixture;

compacting the blended powder mixture to form a compacted material; and breaking said compacted material to form the granulated copper/molybdenum disulfide powder.

37. The method of claim 36, wherein providing a supply of copper-containing powder comprises providing a supply of copper-containing powder selected from the group consisting essentially of metallic copper powder, copper (I) oxide (cuprous oxide) powder, and copper (II) oxide (cupric oxide) powder.

38. The method of claim 35, wherein said providing a supply of granulated copper/molybdenum disulfide powder further comprises:

providing a supply of a copper-containing powder;

providing a supply of molybdenum disulfide powder;

providing a supply of a granulating fluid;

mixing together the copper-containing powder, the molybdenum disulfide powder, and the granulating fluid to form a slurry; and drying the slurry to form the granulated copper/molybdenum disulfide powder.

39. The method of claim 38, wherein providing a supply of copper-containing powder comprises providing a supply of copper-containing powder selected from the group consisting essentially of metallic copper powder, copper (I) oxide (cuprous oxide) powder, and copper (II) oxide (cupric oxide) powder.

40. A metal article comprising a copper/molybdenum disulfide composite powder formed to a solid mass, said copper/molybdenum disulfide composite powder comprising a substantially homogeneous dispersion of copper and molybdenum disulfide sub-particles fused together to form generally spherically-shaped individual particles of said copper/molybdenum disulfide composite powder in which each particle contains substantially the same amount of molybdenum disulfide.

* * * * *